US007155874B2

(12) United States Patent
Lee

(10) Patent No.: US 7,155,874 B2
(45) Date of Patent: Jan. 2, 2007

(54) TUBULAR STRUCTURE AND MODULAR BUILDING ASSEMBLY USING THE SAME

(76) Inventor: Dae-Jun Lee, 3, Namsong-ri, Heunghae-eub, Buk-gu, Pohang-city, Gyungbuk 791-708 (KR)

( * ) Notice: Subject to any disclaimer, the term of this patent is extended or adjusted under 35 U.S.C. 154(b) by 49 days.

(21) Appl. No.: 10/468,063

(22) PCT Filed: Feb. 14, 2002

(86) PCT No.: PCT/US02/04280

§ 371 (c)(1),
(2), (4) Date: Aug. 14, 2003

(87) PCT Pub. No.: WO02/066760

PCT Pub. Date: Aug. 29, 2002

(65) Prior Publication Data

US 2004/0093825 A1 May 20, 2004

(30) Foreign Application Priority Data

Feb. 15, 2001 (KR) ..... 2001-0003816 U

(51) Int. Cl.
*E04C 3/30* (2006.01)

(52) U.S. Cl. ..... 52/731.2; 52/737.6; 52/730.6; 52/731.7

(58) Field of Classification Search ..... 52/730.1, 52/730.4, 731.1, 731.2, 731.4, 732.1, 732.2, 52/736.1, 737.1, 737.6, 127.7, 730.6, 731.7, 52/726.3, 696
See application file for complete search history.

(56) References Cited

U.S. PATENT DOCUMENTS 854,947 A * 5/1907 Hill ..... 52/731.2
1,472,897 A * 11/1923 Anderson ..... 52/298
1,975,228 A * 10/1934 Grumman ..... 52/731.7
2,765,057 A * 10/1956 Stiefvater ..... 52/773
2,975,874 A * 3/1961 Pagan ..... 138/163
3,282,005 A * 11/1966 Birdwell ..... 52/364
4,691,891 A * 9/1987 Dionne ..... 248/551
4,993,095 A * 2/1991 Lautensleger et al. ..... 14/74.5
5,625,997 A * 5/1997 Callahan et al. ..... 52/737.3
5,921,053 A * 7/1999 Callahan et al. ..... 52/731.2
6,826,885 B1 * 12/2004 Raskin et al. ..... 52/731.2

* cited by examiner

*Primary Examiner*—Jeanette Chapman
*Assistant Examiner*—Yvonne M. Horton
(74) *Attorney, Agent, or Firm*—Harold L. Novick

(57) ABSTRACT

This invention relates to an elongated hollow non-deformable structure that can be used as beams and pillars of modular building structures. The structure includes first and second elongated C-shaped channels (20) with inwardly bent flanges (25) and means for holding the two channels (20) together so that the flanges (25) contact each other. The first and second C-shaped channels (20) may be formed without flanges (25). L-shaped (42) and T-shaped (40) and H-shaped flanges of appropriate design are provided with holes in the flanges at predetermined locations to correspond to the holes in the end portions of the beams and pillars. There are plugable holes (21) provided in the end portions of the beams and pillars so that workers can easily access inside the hollow space to use nuts (72), washers, and bolts (70) to couple the elongated hollow structures together. Instead of the C-shaped channel (20) structure two identical L-shaped channels (20*b*) may be used.

15 Claims, 16 Drawing Sheets

TUBULAR STRUCTURE AND MODULAR BUILDING ASSEMBLY USING THE SAME

FIELD OF THE INVENTION

The present invention relates to a hollow tubular structure usable as a pillar or a beam in a building, and to a building assembly comprised of tubular pillar and beam structures assembled on a concrete foundation.

BACKGROUND OF THE INVENTION

In the case of a current architectural structure constructed using pillar and beam structures, a light-weight frame member can be used to make the pillars. The resulting architectural structure has an increased space, an excellent heat isolation ability and a strong moisture-prevention capability, to thus provide a comfortable housing environment. However, the manufacturing of the existing pillar and beam structures is a complicated construction process. That is, the manufacturing of the pillars and beams from respective connection portions requires a welding of the portions together, which impedes an efficient assembly. Also, it is not easy to maintain heat isolation at the beam and pillar connection sections. As a result, it is very difficult to prevent a moisture formation and to maintain a refractory performance.

For example, in the case of a house made of a conventional steel frame I-beam structure, an I-beam having a wide flange "a" is used as a pillar as shown in FIG. 16. In order to connect I-beam "a" used as a pillar with an I-beam "b" used as a beam, the beam must be welded to the pillar away from the construction site, and then the welded I-beam structure must be transported from the welding place to a construction site. In the case where the structure itself is large in size, it is difficult to transport the I-beam structure because it may be damaged during transportation, and a somewhat difficult welding job may be required during construction on site, which causes a difficult construction. Further, it is expensive to purchase pillar and beam structures and assembly components thereof.

Also, there is a problem in a connection structure that connects a pillar to a beam together as well as in an existing pillar and beam structures, where the connection structure is a wide flange abutting an external structure that is integrally connected with an internal structure. This problem is the formation and accumulation of moisture Accordingly, in order to prevent moisture formation, all portions abutting the external structure should be wrapped with a heat isolation material. This moisture problem and the use of heat isolation material results in a steel frame structure being expansive, and in turn resulting in an expansive architectural building. The expansive or enlarged building has a resulting external appearance that is unsightly and thus does not present a steel structure architecture having a light and nimble appearance.

DISCLOSURE OF THE INVENTION

To solve the above problems, it is an object of the present invention to provide a tubular structure which can be applied to a pillar or a beam that is comprised of a plurality of channels each of a predetermined section which can be assembled without any welding in order to solve problems in assembling structures as in a conventional architectural building.

It is another object of the present invention to use a tubular structure assembly in the construction of a building, wherein the tubular structure is used selectively as beams and as pillars and more particularly to a tubular structure that is comprised of first and second channel members each having a predetermined shape are aligned to oppose and engage each other.

Yet another object of the present invention is to be able to assemble a building assembly of tubular pillar structures and tubular beam structures on a concrete foundation.

It is another object of the present invention to provide a tubular structure comprised of channel having inwardly extending lips or flanges in which each edge in a C-shaped section is bent inwards (hereinafter referred to as a flanged C-shaped channel), a C-shaped channel of a C-shaped section (hereinafter referred to as a C-shaped channel), or an L-shaped channel of an L-shaped section (hereinafter referred to as an L-shaped channel).

It is still another object of the present invention to provide a connection structure necessary for connecting a pillar section and a pillar section, a pillar and a beam, or a beam section and a beam section.

It is yet another object of the present invention to provide a connection piece necessary for a connection structure in addition to a supply of the connection structure.

It is a further object of the present invention to provide a building assembly made of a pair of channels to improve heat isolation.

To accomplish the above objects in a specific embodiment of the present invention, there is provided a tubular structure comprising: a first elongated C-shaped channel with a flange along the length thereof; a second elongated C-shaped channel with a flange along the length thereof of the same design as the first rigid elongated C-shaped channel; and means for holding the two channels together so that the flange of the first C-shaped channel engage and contact the flange of the second C-shaped channel, wherein the flanges of the first and the second C-shaped channels are respectively inwardly bent and the surfaces of the flanges coming in contact with each other are planar and form an airtight seal along the length thereof, whereby a hollow elongated tubular structure is formed.

Preferably, the first and the second channels are made of a rigid material so that the tubular structure is substantially non-deformable.

Preferably, the first and second channels are made of steel.

Preferably, the means for holding the first and the second C-shaped channels together comprises a bolting means comprising a bolt with a head and a threaded stem and a nut. A detent means maintains the spatial distance between the opposing inside faces of the two C-shaped channels a predetermined distance as the bolt is placed and the nut is rotated to couple and tighten the two C-shaped channels together.

There is also provided a building assembly comprising hollow tubular structures, wherein a plurality of the structures are adopted for use as beams and as pillars selectively, means for anchoring the bottom ends of selected ones of the pillars on a support foundation for a building and means for coupling a second pillar on top of the first pillar end to end, and means for coupling the beams to the pillars, for building a framework of a modular building.

Preferably, the anchoring means comprises a flange of a predetermined design with a plurality of holes at predetermined positions, an end of the hollow tubular pillars provided with a plurality of holes at predetermined positions for alignment with the holes in the flange, and a plurality of nuts, washers and bolts for bolting the one end of the pillar to the flange and the other end of the flange to the foundation.

Preferably, the building assembly comprises anchoring means for the pillar including an L-shaped flange, with the base portion provided with holes for receiving the threaded rods of the bolts, the heads of which are embedded in a solid foundation for the building, the vertical portion having holes to align with holes in the sides of the bottom end of the pillar, nuts, bolt and washer means for bolting the end portion of the pillar to the vertical portion of the flange and for bolting the base portion of the flange to the foundation, for anchoring the pillar to the building foundation.

Preferably, the coupling means includes an H-shaped type flange of a size such that it fits inside the hollow space of the pillars and is positioned so that one flange is located inside the top end portion of the first pillar, the other end thereof being fitted inside the bottom end of a second pillar, the H-shaped flange and the end portions of the first and second pillars are provided with a plurality of holes at predetermined positions, nuts, bolts and washer means for bolting the first and the second pillars to the H-shaped flange through the holes. (FIG. 10).

Preferably, the H-shaped flange is positioned to provide continuity of empty space between the two pillars, whereby utility lines such as water pipe, communications or power supply cable lines can be run through the hollow spaces provided by the first and the second hollow tubular pillars, the H-shaped flange and the top end portion of first pillar and the bottom end portion of the second pillars which are provided with holes at predetermined positions.

Preferably, the coupling means for mounting the beam transverse to the pillar includes T-shaped flanges designed to fit inside the hollow space of the beam made of the pillar structure, wherein the T-shaped flanges and an end portion of the beam are provided with a plurality of holes at predetermined positions, nut, bolt and washer means for fastening the T-shaped flange to the H-shaped flange and to the beam through the plurality of holes provided therein.

Preferably, the flanges of the beam toward the end thereof are eliminated to accommodate the T-flange being inserted into the hollow beam.

Preferably, the assembly comprises a pair of T-shaped flanges, each with a plurality of holes in the T-shaped flanges at predetermined positions. The pair of flanges are dimensioned and positioned so that their base portions are in parallel and the flanges meeting the inner surface at the end portion of the C-shaped channel, and nuts, washers and bolt means for bolting together the beam end to the H-shaped member that couples two pillars. (FIG. 10)

Preferably, the beams and the pillars are provided with plugable access holes adjacent the holes in the ends thereof for facilitating access into their respective inner hollow spaces for facilitating the bolting operations for mounting the bolts and nuts and washers, to couple and tighten pillars to the building foundation, pillars to pillars, and beams to pillars, thereby facilitating the assembly of a building.

Preferably, an insulating means is inserted between the T-shaped flanges and the end portions of two pillars such that the hollow space inside of the two pillars is insulated from the exterior.

There is also provided a non-deformable elongated hollow structure useable as a pillar or as a beam, comprising a pair of substantially identical C-shaped channels, and means for mating and coupling the pair of the C-shaped channels into each other to form a hollow rectangular elongated structure.

There is also provided an assembly comprising a plurality of the hollow elongated structures, wherein the structures are adopted to be the pillars and the beams of a modular building assembly structure, means comprised of flanges and nuts and bolts and washers and a plurality of holes provided in the flanges and in the end portions of the tubular structures used as the beams and as the pillars, plugable holes provided in the pillars and beams for facilitating the use of wrenches and pliers to couple the pillars and the beams together and to the foundation through the flanges to build a framework for an building.

Preferably, the assembly includes means for reinforcing the two C-shaped channels by bolting the two channels with bolts, nuts, washers and a retainer for maintaining the space between the inner opposite walls of the C-shaped channels as the nut is rotated to tighten the bolt and nut to hold the two opposing C-shaped channels together.

Preferably, to enforce the coupling strength of the C-shaped channels, the contacting flange portions are spot-welded.

There is also provided a non-deformable elongated hollow structure useable as a pillar or as a beam, comprising a pair of substantially identical L-shaped channel, means for mating and coupling the pair of the L-shaped channels together to form a hollow rectangular elongated structure.

There is also provided an assembly comprising a plurality of the hollow elongated structures wherein the structures are adopted to be the pillars and the beams of a modular building assembly structure, means comprised of flanges and nuts and bolts and washers and a plurality of holes provided in the flanges and in the end portions of the tubular structures, plugable holes provided in the pillars and beams for facilitating the use of wrenches and pliers to couple the pillars and the beams together and to the foundation through the flanges to build a framework for an building.

Preferably, the assembly includes means for reinforcing the two L-shaped channels by bolting the two channels with bolts, nuts, washers and a retainer for maintaining the space between the inner opposite walls of the L-shaped channels as the nut is rotated to tighten the bolt and nut to hold the two opposing L-shaped channels together.

Preferably, to enforce the coupling strength of the L-shaped channels, the contacting flange portions are spot-welded.

There is also provided a connection structure for connecting tubular structures which are assembled with first and second channels, each having the same cross-section and which butt each other, and a connection unit for connecting the first and second channels. The connection structure compresses: a wide flange for reinforcing a connection force necessary for connecting the vertically extended first and second channels, the wide flange being positioned in the first and second channels and provided with several connection holes thereon; connection pieces provided with connection holes for connecting a pillar structure and a pillar structure, a pillar structure and a beam structure, and a beam structure and a beam structure; and connection units for connecting the pillar structure, the wide flange, the beam structure and the connection pieces.

Preferably, the connection piece is of a T shape, or an L shape.

Preferably, the first and second channels are provided with working access holes for facilitating an engagement of the wide flange at predetermined positions and a closure for closing the working access hole.

Preferably, the connection structure further comprises a reinforcing plate in which connection holes are formed in order to reinstate a height of the inserted portion of the wide flange at the time of engaging the connection pieces.

Preferably, in the case of the connection structure of the pillar and beam structures, a pair of C-shaped channels with inwardly bent flanges, C-shaped channels without inwardly bent flanges or L-shaped channels are connected to form a pillar or a beam by using bolts for attaching the wide flange and the channels, and a heat isolation material is filled between the, flanged C-shaped channel, C-shaped channel or L-shaped channel and the wide flange where an external portion meets an internal portion, to thereby prevent the formation of moisture or dew.

Preferably, in the case of the connection structure of the tubular structures, pipes for water supply and drainage, electric power cables and telecommunication cables pass through the hollow area of the structures, to thereby free-up a variety of architectural spaces.

BRIEF DESCRIPTION OF THE DRAWINGS

The above objects and other advantages of the present invention will become more apparent in the detailed description of the preferred embodiments thereof with reference to the accompanying drawings in which:

FIG. 8 is an enlarged, exploded, and perspective view of portion "A" of. FIG. 7, in which a pillar structure according to the present invention is connected and fixed to a concrete foundation;

FIGS. 9A, 9B and 9C are sectional views of FIG. 7 taken along line C—C, in which FIG. 9A shows a connection structure of a pillar structure according to the present invention in which a first example of a channel has been applied, FIG. 9B shows a connection structure of a pillar structure according to the present invention in which a second example of a channel has been applied, and FIG. 9C shows a connection structure of a pillar structure according to the present invention in which a third example of a channel has been applied;

BEST MODE FOR CARRYING OUT THE INVENTION

Figure 1:
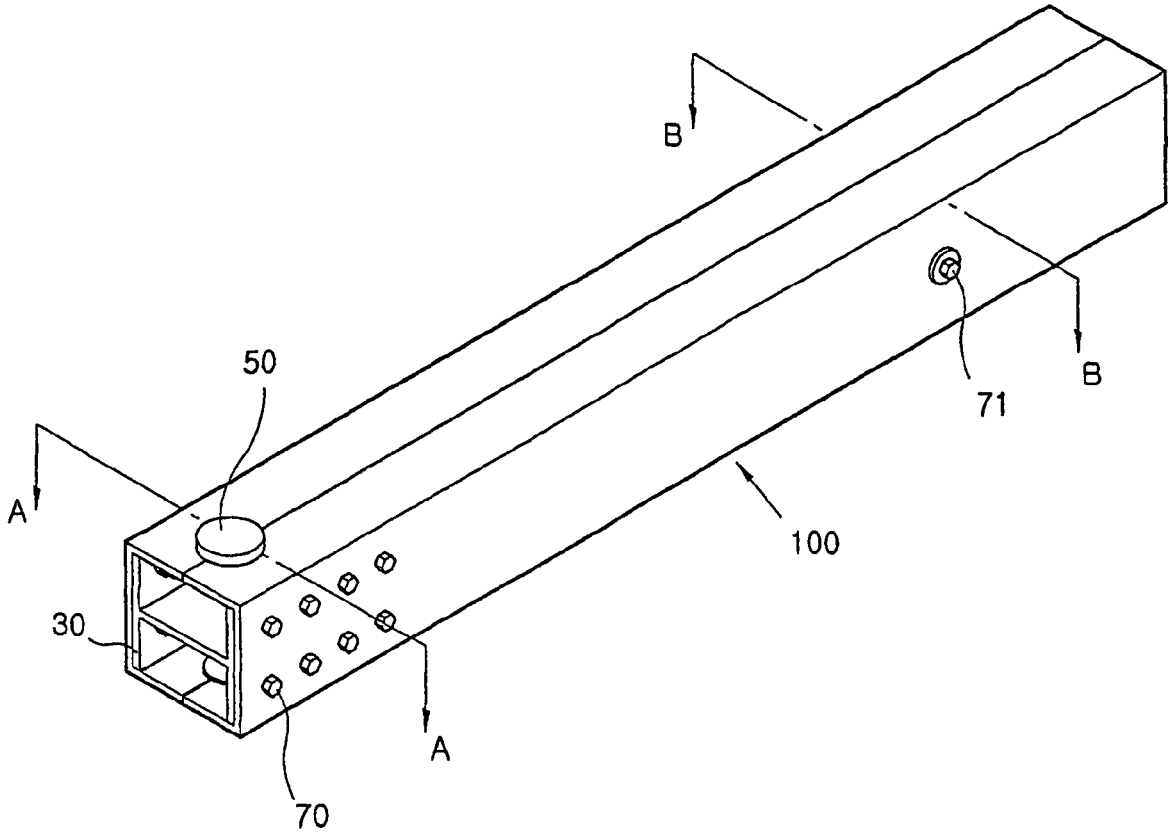
FIG. 1 is a perspective view of a tubular structure according to a first embodiment of the present invention in which channels have been assembled.

Preferred embodiments of the present invention will be described with reference to the accompanying drawings.

Referring to FIGS. 1 through 3B, a tubular structure according to a first embodiment of the present invention is made of two channels, that is, first and second channels 20 each having a C-shaped section with inwardly bent lips or flanges, in which the first and second channels 20 are opposed to each other and assembled with each other. In each of the first and second channels 20, connection holes 22 are formed on the wide surfaces, flanges 25 which are bent inwards are formed at the edges of the opening sides on the narrow surfaces, and the flanges 25 are removed from the edges of the opening sides on the narrow surfaces only at the portions where the connection holes 22 are formed.

Also, the half a working access hole 21 is located on each of the narrow surfaces of the first and second channels 20. After assembly, a closure 50 is inserted in each of the working access holes 21.

Connection holes 23 are located at the intermediate portion on each of the wide surfaces in the tubular structure. The connection holes 23 are fitted with a long bolt 71 and are engaged with a nut 73, to thereby support the intermediate portions of the first and second channels 20. A tubular straw or spacer 76 which is fitted on the long bolt 71 is provided inwards from the first and second channels 20.

Figure 3A:
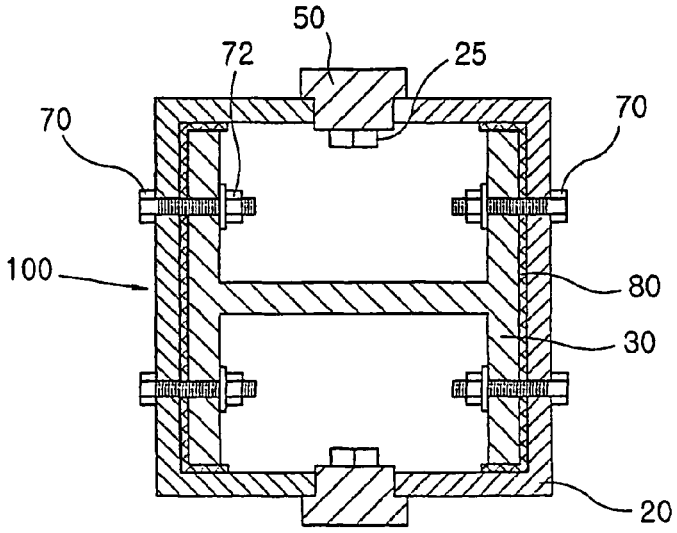
FIG. 3A is a sectional view of FIG. 1 taken along line A—A, which shows the tubular structure according to the first embodiment of the present invention in which channels have been assembled.
Figure 3B:
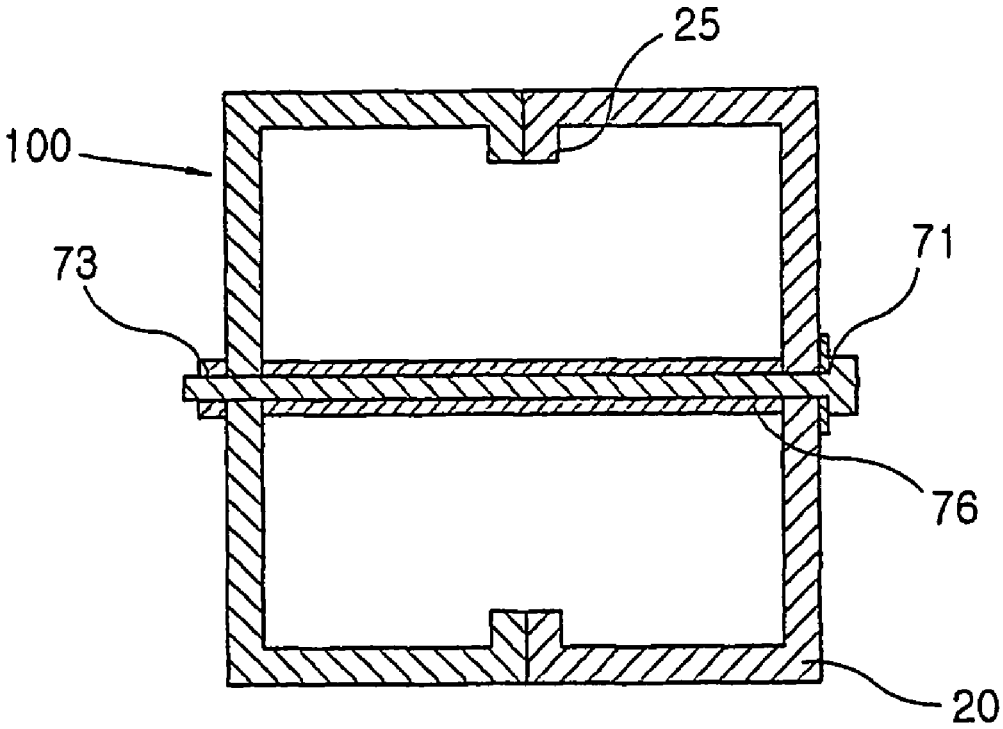
FIG. 3B is a sectional view of FIG. 1 taken along line B—B, which shows the tubular structure according to the first embodiment of the present invention in which channels have been assembled.

As shown in FIGS. 3A and 3B, the tubular structure according to the first embodiment of the present invention is used as a pillar structure or a beam structure since a predetermined rectangular section is formed at the point where the first and second channels 20 are assembled.

Figure 4:
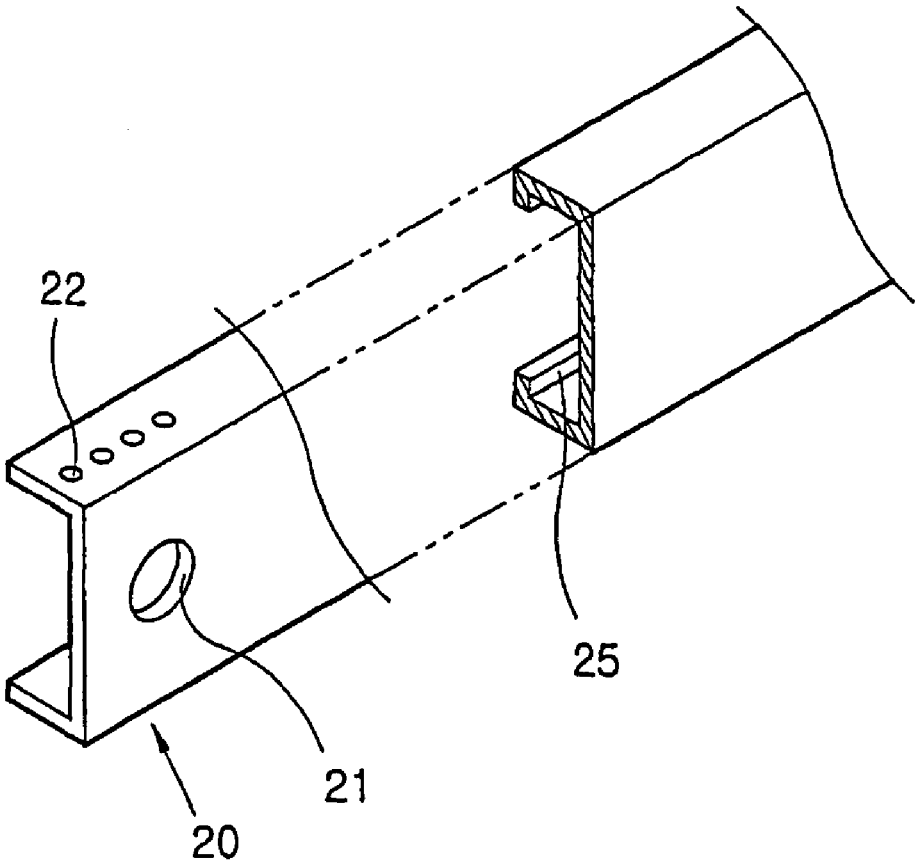
FIG. 4 is a perspective view of another example of a channel which can be employed in the tubular structure according to the first embodiment of the present invention.

FIG. 4 is a perspective view of another example of a channel 20 which can be employed in the tubular structure according to the first embodiment of the present invention, in which connection holes 22 are formed on narrow surfaces of the channels, and working access holes 21 are formed on wide surfaces thereof.

Referring to FIG. 4, the assembled structure of the channels 20 are opposed to the tubular structure according to the first embodiment of the present invention, as shown in FIGS. 1 through 3B, in which the wide surfaces and the narrow surfaces of FIG. 4 play the opposite roles to those of the first embodiment.

Figure 5A:
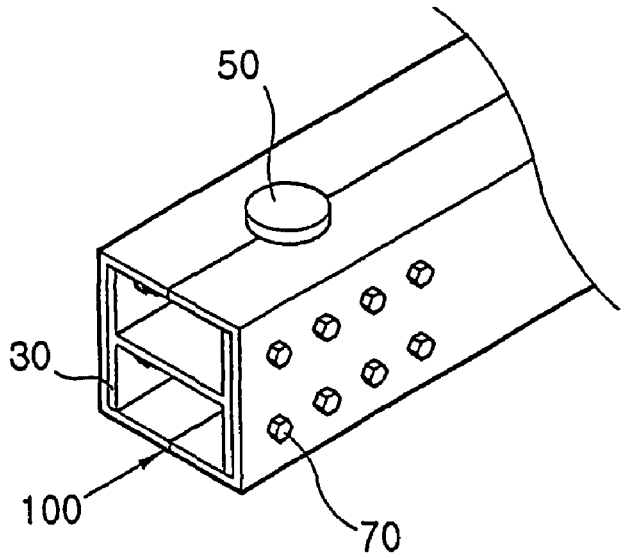
FIG. 5A is a perspective view of a tubular structure according to a second embodiment of the present invention in which channels have been assembled.
Figure 5B:
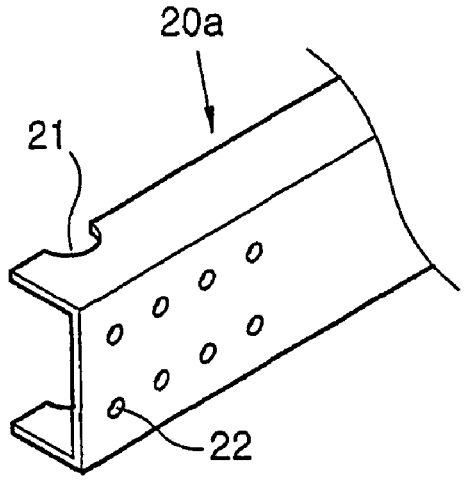
FIG. 5B is a perspective view of a channel disassembled from the structure according to the second embodiment of the present invention.

FIG. 5A is a perspective view of a tubular structure according to a second embodiment of the present invention in which channels have been assembled, and FIG. 5B is a perspective view of a channel disassembled from the tubular structure according to the second embodiment of the present invention.

Referring to FIGS. 5A and 5B, the tubular structure according to the second embodiment of the present invention is provided with the first and second channels 20*a* in which the flanges 25 of the first embodiment has been removed from the inner bent portions, differently from the channels 20 of the first embodiment.

In the tubular structure according to the second embodiment of the present invention as shown in FIGS. 5A and 5B, the channels each having the C-shaped section which are the first and second channels 20*a* each having the same section are aligned to face each other and assembled with each other. In each of the first and second channels 20*a*, the connection holes 22 are formed on the wide surface in which the narrow surface is formed inwards from the channel.

Also, the half a working access hole 21 is formed on each of the narrow surfaces of the first and second channels 20*a*. After assembly, a closure 50 is inserted therein and removed therefrom.

The connection holes 23 are located in the intermediate portions of the tubular structure and fitted with a long bolt 71 and are engaged with a nut 73, to thereby support the intermediate portions of the first and second channels 20*a*.

Like the first embodiment of the present invention, a spacer 76 mounted on a long bolt 71 is provided in the inside of the first and second channels 20*a*. As a result, the pillar structure and the beam structure of the second embodiment of the present invention form a section of a predetermined rectangular shape at the state where the first and second channels 20*a* each having a C-shaped section are abutted to each other and assembled with each other.

Figure 5C:
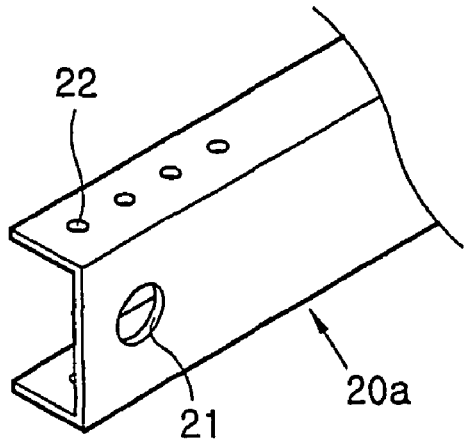
FIG. 5C is a perspective view of another example of a channel which can be employed in the structure according to the second embodiment of the present invention.

FIG. 5C is a perspective view of another example of a channel which can be employed in the tubular structure according to the second embodiment of the present invention, in which the installation positions of connection holes 22 and the working access holes 21 are altered from the first embodiment of the present invention. That is, the connection holes 22 are formed on the narrow surfaces being the opening edges of the first and second channels 20*a* and the working access holes 21 are formed on the wide surfaces thereof.

Figure 6A:
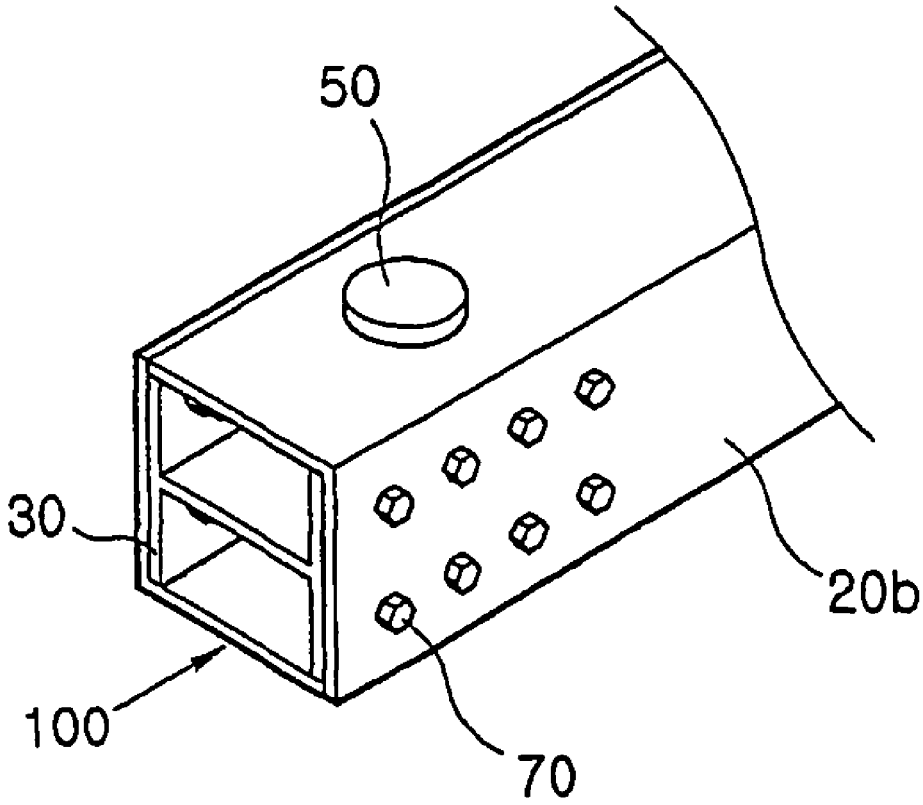
FIG. 6A is a perspective view of a tubular structure according to a third embodiment of the present invention in which channels have been assembled.
Figure 6B:
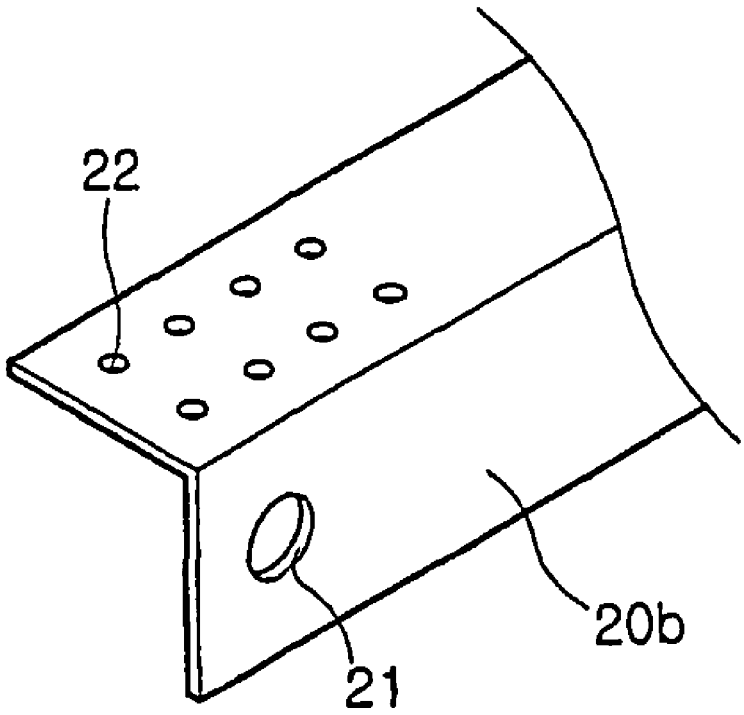
FIG. 6B is a perspective view of a channel disassembled from the tubular structure according to the third embodiment of the present invention.

FIG. 6A is a perspective view of a tubular structure according to a third embodiment of the present invention in which channels have been assembled, and FIG. 6B is a perspective view of a channel disassembled from the structure according to the third embodiment of the present invention.

Referring to FIGS. 6A and 6B, channels 20*b* applied in the tubular structure according to the third embodiment of the present invention each have an L-shaped cross-section and are opposed to each other and assembled with each other.

Since the working access holes 21, the connection holes 22 and 23, the closure 50 and the reinforcement unit in the third embodiment are provided like the first and second embodiments, the detailed description thereof will be omitted.

Figure 7:
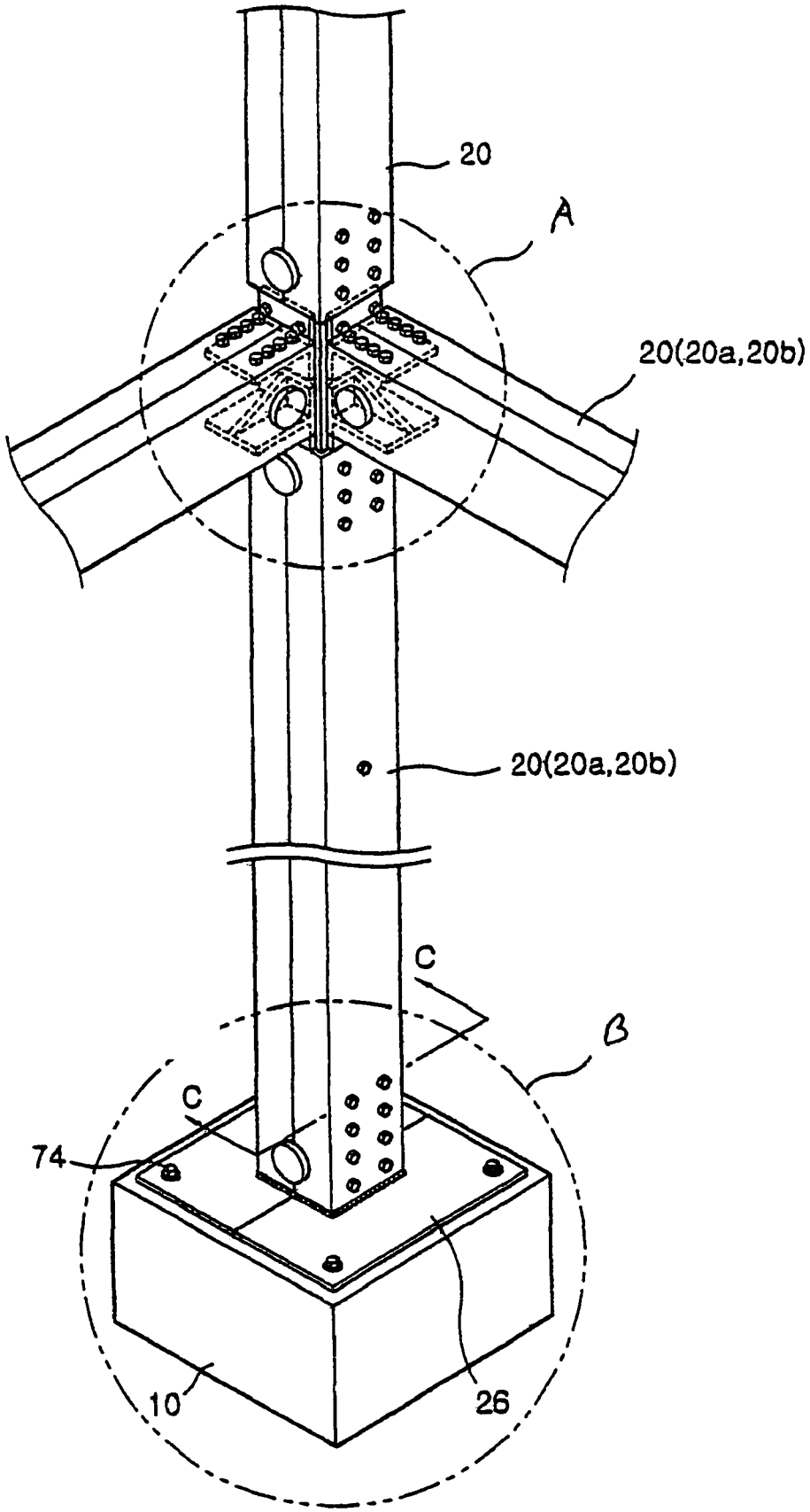
FIG. 7 is a perspective view showing an example of a tubular structure in which structures according to the present invention are connected.

FIG. 7 is a perspective view showing part of the whole tubular structure illustrating examples of connection structures of the pillar and pillar and beam and beam according to the present invention.

Referring to FIG. 7, the lower portion of the pillar structure according to the present invention is a portion "A" which is vertically mounted on a concrete foundation 10. Also, the beam structure is a portion "B" which is extended from the lateral portion of the pillar structure. That is, the pillar structure is vertically fixed on the concrete foundation 10, and the beam structures are extended from the appropriate portion of the pillar structure according to the present invention.

Figure 8:
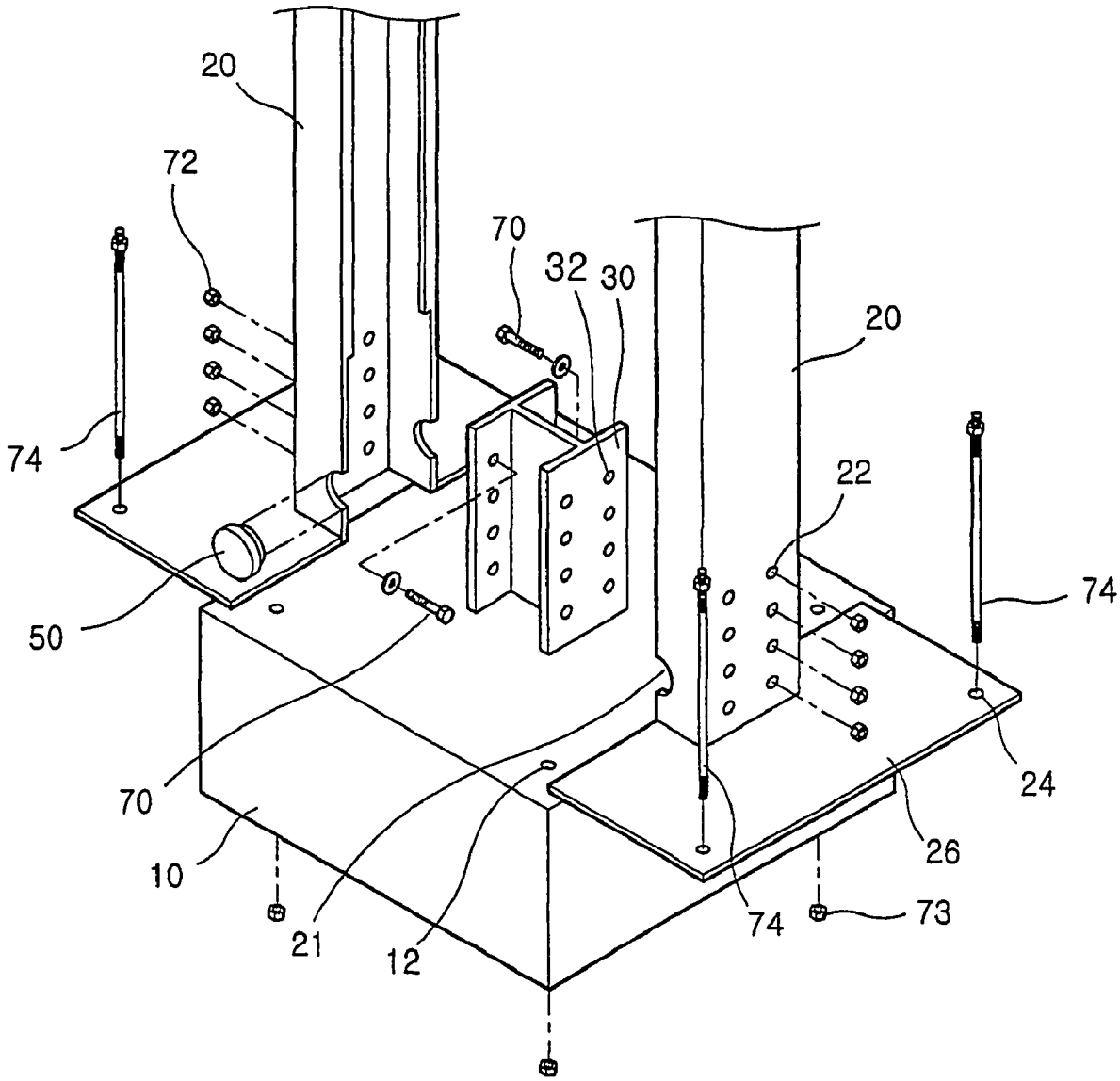

FIG. 8 is an enlarged, exploded, and perspective view of portion "A" of FIG. 7, in which a pillar structure according to the present invention is connected and fixed to a concrete foundation.

As shown in FIG. 8, the pillar structure is assembled on the concrete foundation 10. The concrete foundation 10 is a heavy-weight product of a substantially rectangular shape, in which relatively long fixing holes 12 are formed in the four corners on the concrete foundation 10. Anchor bolts 74 are threadedly fitted into the fixing holes 12.

When a pillar structure is installed on the concrete foundation 10, support plates 26 are preferably installed on the lower side of each of the channels 20, 20*a*, or 20*b*. For example, a support plate 26 is welded and integrated on the lower side of each of the first and second channels 20, in which connection holes 24 are formed in correspondence to the fixing holes 12. The support plate can be applied to the channels of all the embodiments of the present invention if the shape in the lower portion of the support plate is designed to meet those of the other channels.

Referring to FIG. 8, the pillar structure formed of the first and second channels 20 each having a C-shaped section with inwardly bent flanges are vertically installed on the concrete foundation.

The connection holes 24 are formed on the support plate 26, each of which is fitted with an anchor bolt 74 to accomplish a vertical fixture of the pillar structure.

A wide flange 30 of a predetermined length is fitted between the channels forming the pillar structure. Connection holes 32 are also formed on the wide flange 30, which are engaged during connection of the channels 20, 20*a*, or 20*b*.

Figure 11:
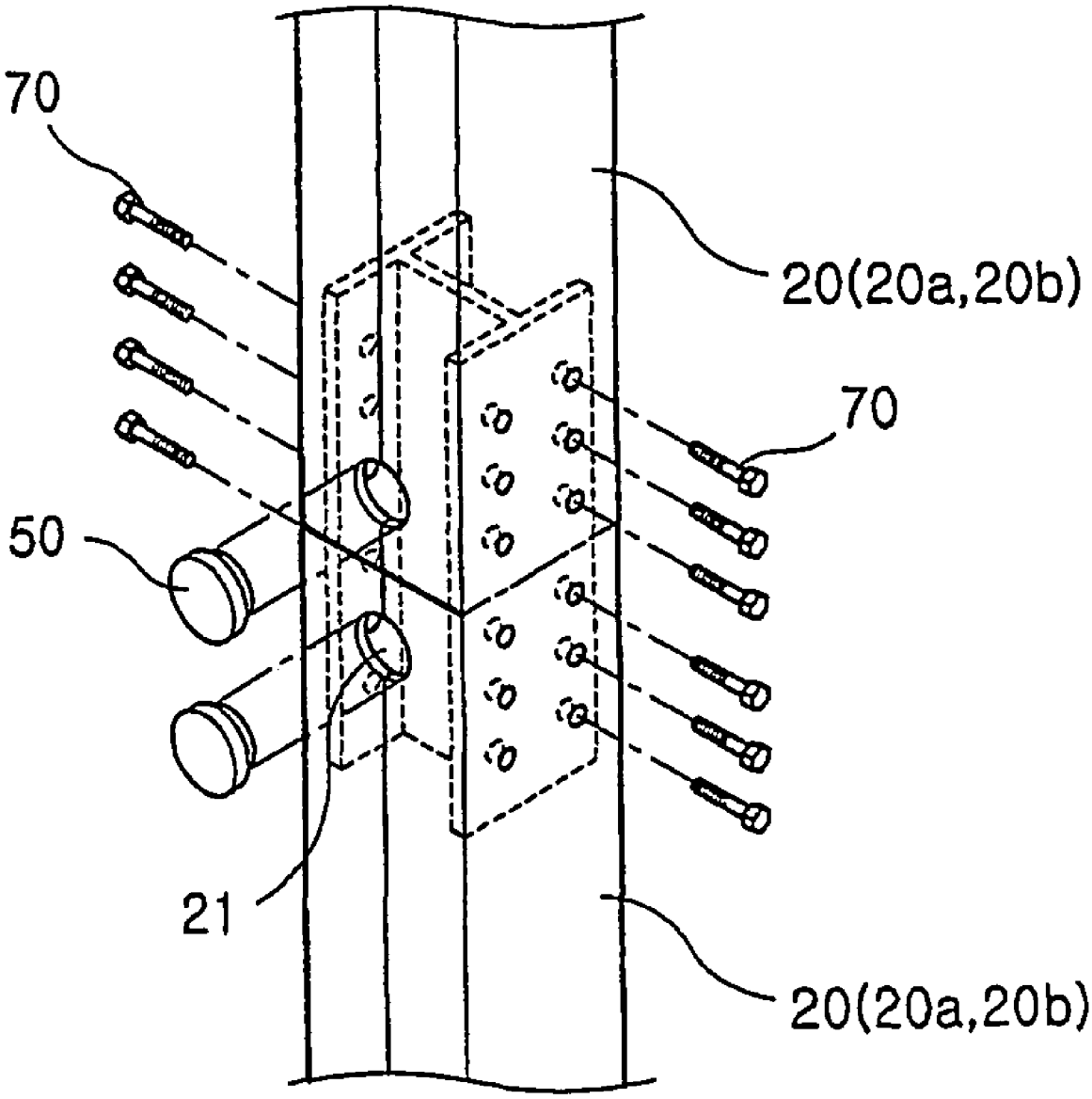
FIG. 11 is a perspective view showing a connection structure of a pillar and a pillar according to the present invention.

Although the pillar structure is installed on the concrete foundation 10 in FIG. 8, it is possible to connect a pillar structure with a pillar structure, which will be described in detail with reference to FIG. 11 illustrating a connection structure.

Figure 9A:
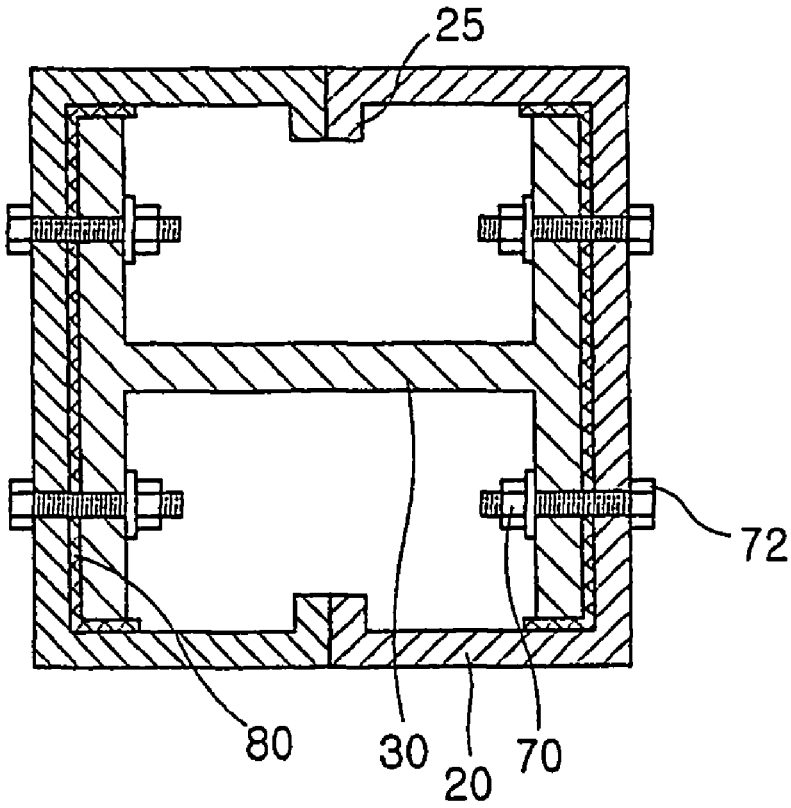
Figure 9B:
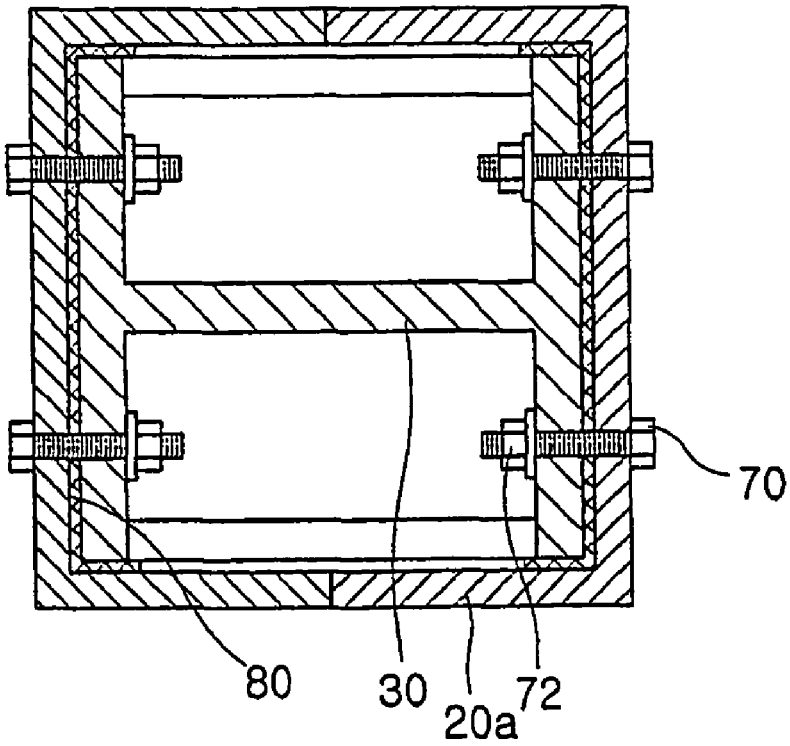
Figure 9C:
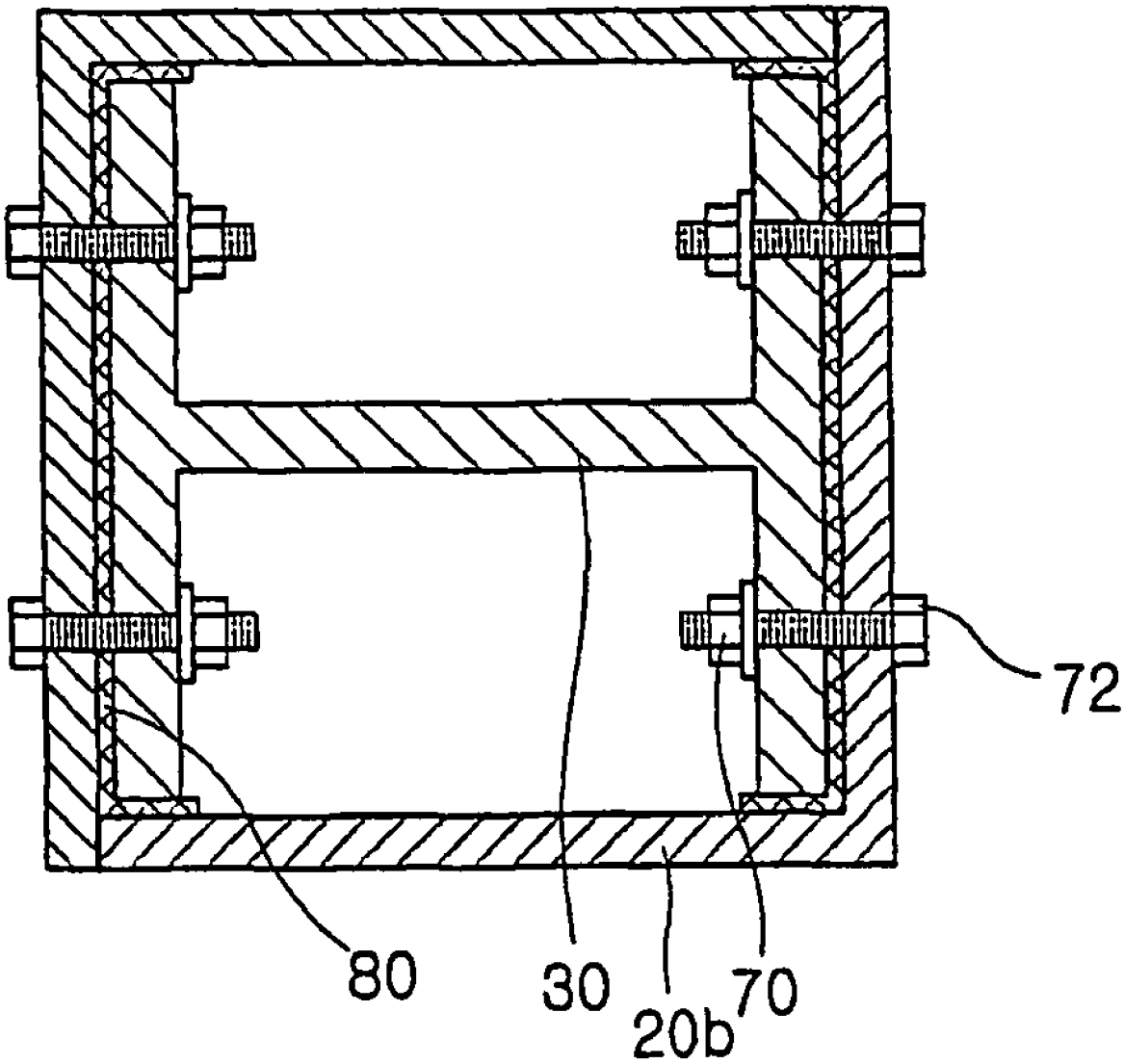

FIGS. 9A, 9B and 9C are sectional views of FIG. 7 cut along line C—C, in which FIG. 9A shows a connection structure of a pillar structure according to the present invention in which a first example of a channel has been applied, FIG. 9B shows a connection structure of a pillar structure according to the present invention in which a second example of a channel has been applied, and FIG. 9C shows a connection structure of a pillar structure according to the present invention in which a third example of a channel has been applied.

The first example of the channel 20 in the-first embodiment of the present invention has a C-shaped section with inwardly bent flanges. As shown in FIG. 9A, each of the channels 20 has a wide surface and a narrow surface which is bent inwards from each of the upper and lower portions of the wide surface. Bent flanges 25 are formed inwards from the narrow surfaces.

Figure 2:
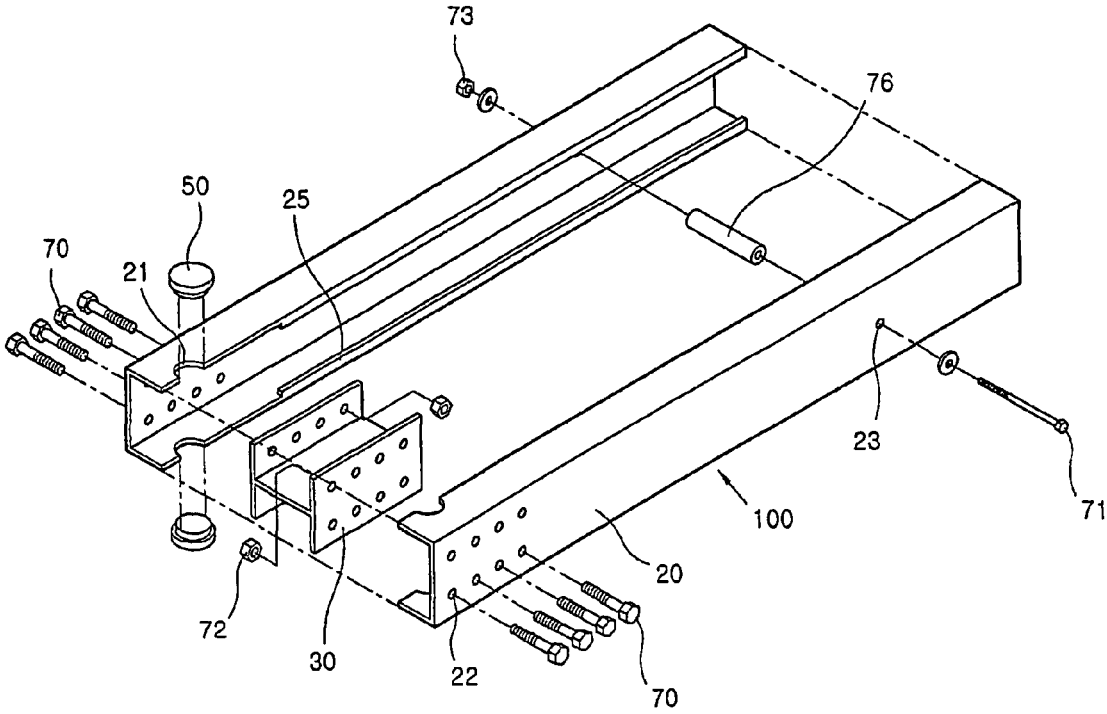
FIG. 2 is a perspective view of the tubular structure according to the first embodiment of the present invention in which channels have been disassembled.

In the case of the pillar structure assembled with the channels 20, the wide flange 30 is positioned inwards between the wide surfaces, which is engaged by bolts 70 and nuts 72. Although they are not shown in FIG. 9A, working access holes 21 may be formed on the narrow surface, on which a closure 50 is fitted as shown in FIGS. 2 and 3A. Also, a heat isolation material 80 can be inserted between the channels and the internal wide flange 30, to thereby prevent moisture formation.

The second example of the channel 20*a* in the second embodiment of the present invention has a C-shaped section. As shown in FIG. 9B, each of the channels 20*a* has a wide surface and a narrow surface which is bent inwards from each of the upper and lower portions of the wide surface. In the case of the pillar structure assembled with the channels 20*a*, the wide flange 30 is positioned inwards between the wide surfaces, which is engaged by bolts 70 and nuts 72. Although they are not shown in FIG. 9B, working access holes 21 may be formed on the narrow surface, on which a closure 50 is fitted as shown in FIGS. 2 and 3A. Also, a heat isolation material 80 can be inserted between the channels and the internal wide flange 30, to thereby prevent moisture formation.

The third example of the channel 20*b* in the third embodiment of the present invention has an L-shaped cross-section. As shown in FIG. 9C, each of the channels 20*b* has two surfaces each having the same width which are perpendicular to each other. In the case of the pillar structure assembled with the channels 20*b*, two channels 20*b* are aligned to oppose each other and engaged with bolts 70 and nuts 72. Here, a wide flange 30 is positioned inwards between the wide surfaces, which is engaged by the bolts 70 and the nuts 72. Although they are not shown in FIG. 9C, working access holes 21 may be formed on the narrow surface, on which a closure 50 is fitted as shown in FIGS. 2 and 3A. Also, a heat isolation material 80 can be inserted between the channels and the internal wide flange 30, to thereby prevent moisture formation.

The purpose of the heat isolation material 80 disposed between the channels 20, 20*a* or 20*b* and the wide flange 30 is to prevent moisture formation due to a temperature difference between the internal and external portions.

Figure 10:
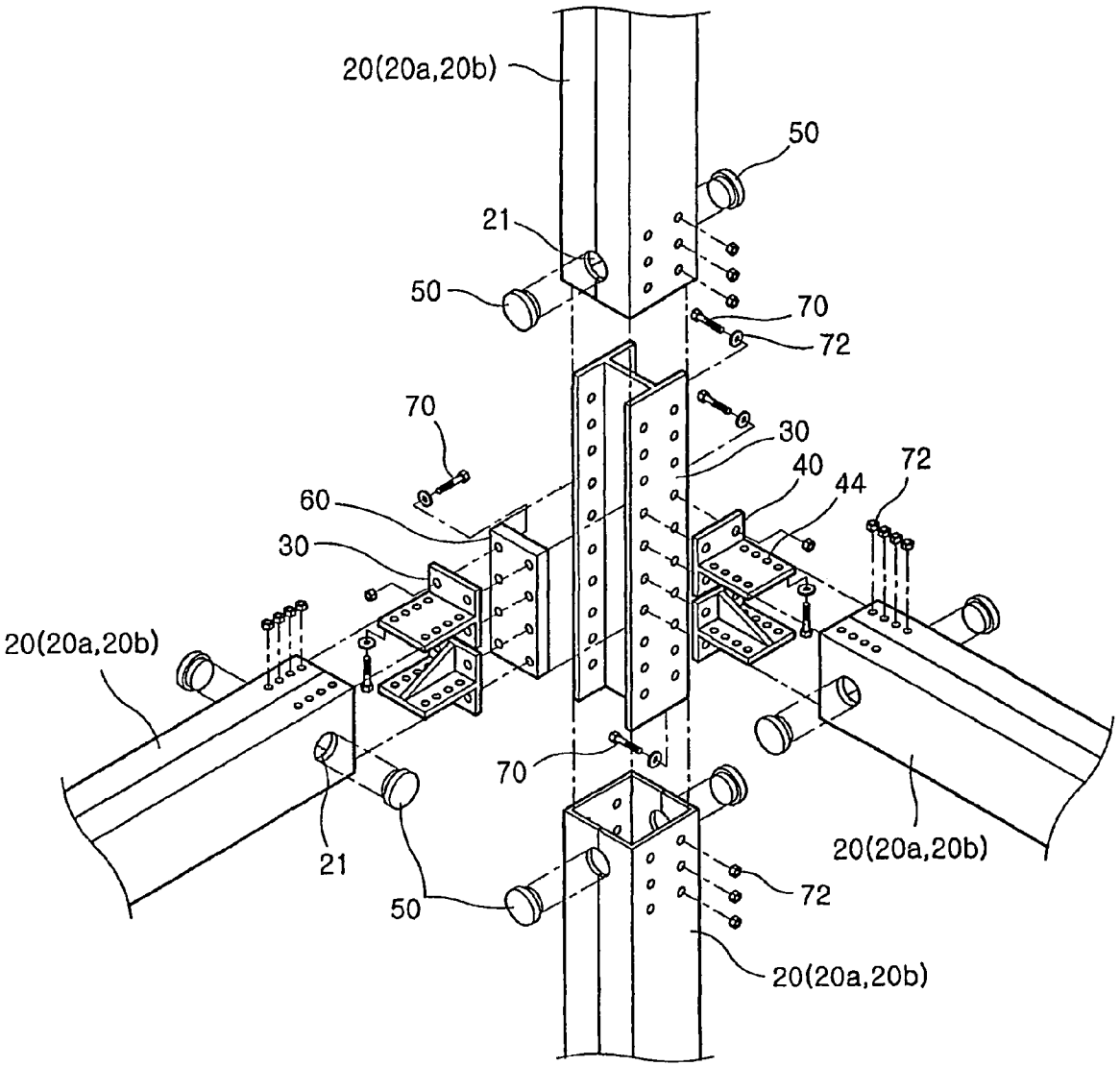
FIG. 10 is an enlarged, exploded, and perspective view of portion "B" of FIG. 7, which shows a connection structure of a pillar and a pillar, and a pillar and a beam according to the present invention.

FIG. 10 is an enlarged, exploded, and perspective view of portion "B" of FIG. 7, which shows a connection structure of a pillar to a pillar, and a pillar to a beam according to the present invention. FIG. 11 is a perspective view showing a connection state of a pillar and a pillar according to the present invention. The pillar and pillar structure according to the present invention as shown in FIGS. 10 and 11 is simple.

As shown in FIG. 11, a wide flange 30 is vertically installed inwards from the space formed by the channels 20, 20*a* or 20*b* between the lower pillar structure and the upper pillar structure, and then the lower and upper ends of the upper pillar structure and the lower pillar structure are abutted and engaged with bolts 70 and nuts 72. In the case of FIG. 10, since beam structures are also connected together with the pillar structures, the upper and lower pillar structures are assembled at the location where the beam structures are spaced by a predetermined distance from the pillar structures, during assembly of the beam structures.

Figure 12A:
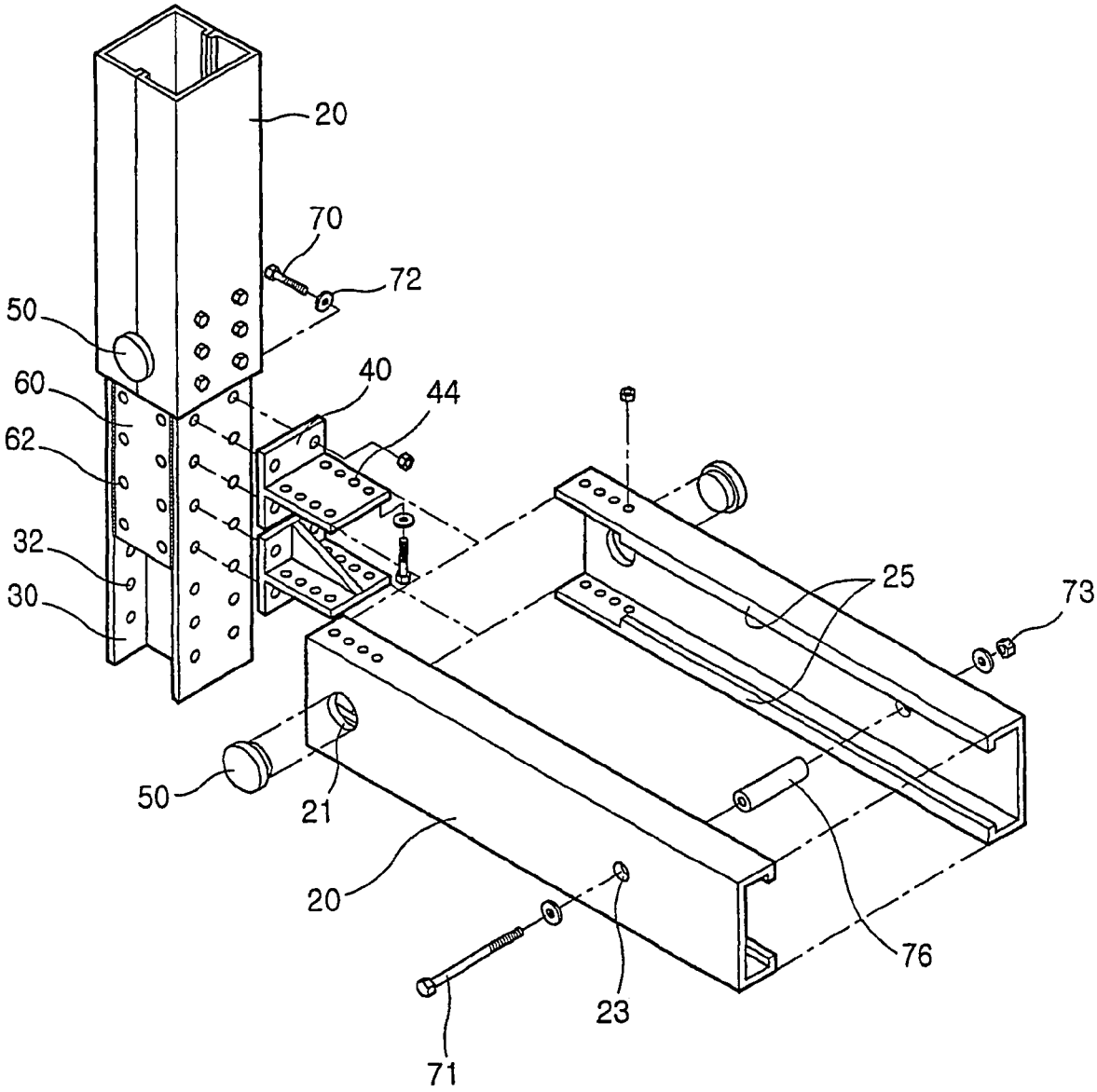
FIG. 12A is an exploded perspective view showing a beam structure according to the present invention in which channels of the first example have been applied, and showing a connection structure of the beam structure with respect to a pillar structure according to the present invention.
Figure 12B:
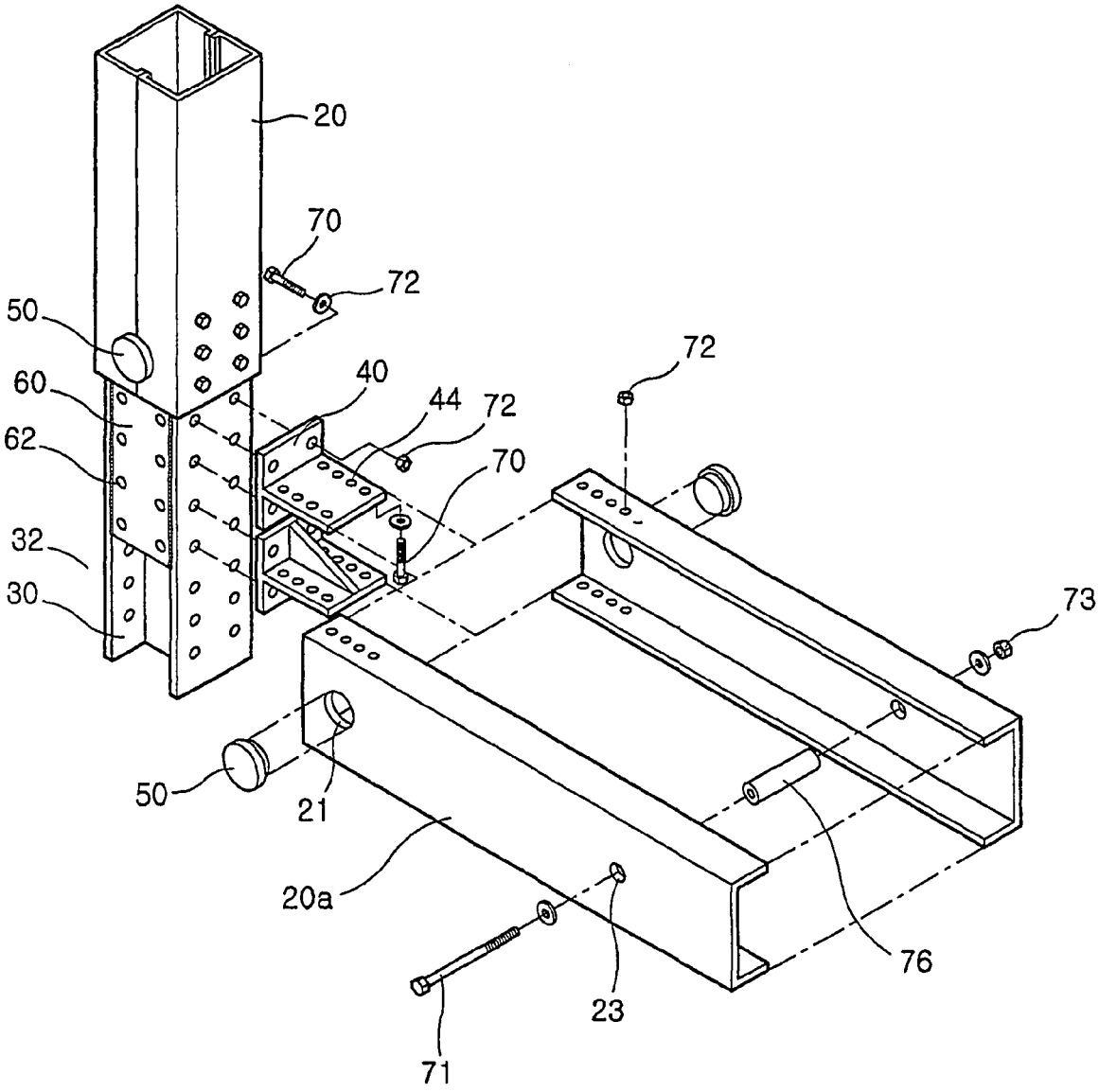
FIG. 12B is an exploded perspective view showing a beam structure according to the present invention in which channels of the second example have been applied, and showing a connection structure of the beam structure with respect to a pillar structure according to the present invention.
Figure 12C:
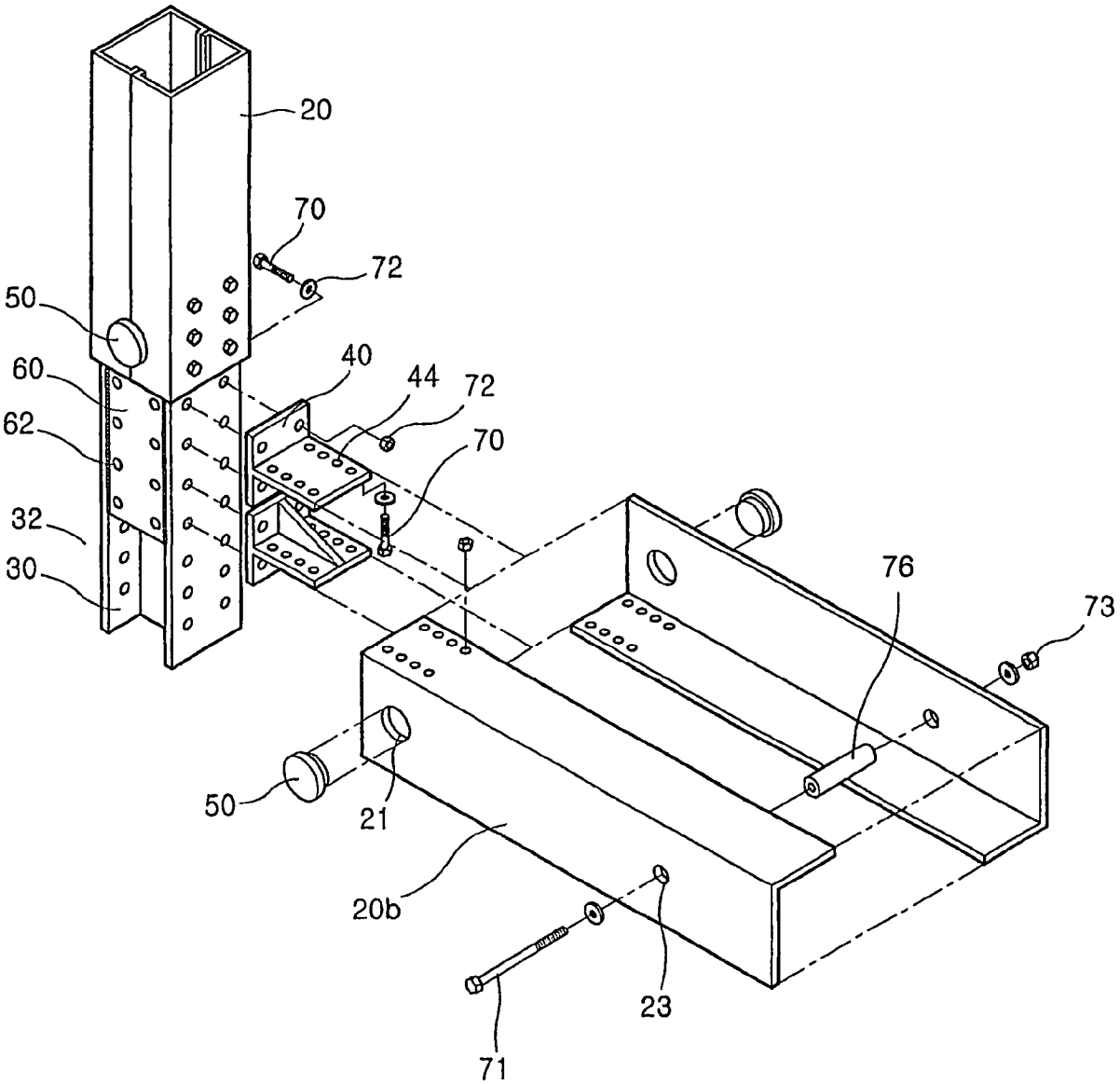
FIG. 12C is an exploded perspective view showing a beam structure according to the present invention in which channels of the third example have been applied, and showing a connection structure of the beam structure with respect to a pillar structure according to the present invention.
Figure 13A:
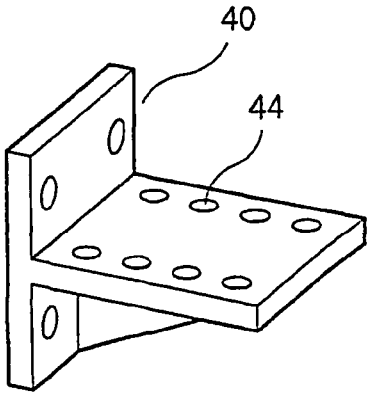
FIG. 13A is a perspective view showing a connection piece of a T-shaped section which is applied to a connection for a pillar to a beam structure according to the present invention.
Figure 13B:
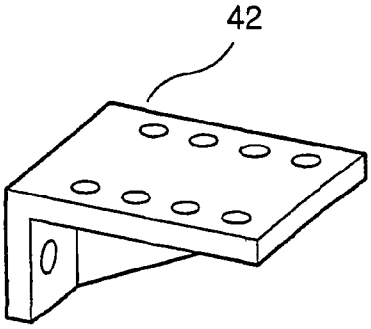
FIG. 13B is a perspective view showing a connection piece of an L-shaped section which is applied to a connection for a pillar to a beam structure according to the present invention.

FIG. 12A is an exploded perspective view showing a beam structure according to the present invention in which channels of the first example have been employed together with a connection structure of the beam structure with respect to a pillar structure according to the present invention. FIG. 12B is an exploded perspective view showing a beam structure according to the present invention in which channels of the second example have been employed together with a connection structure of the beam structure with respect to a pillar structure according to the present invention. FIG. 12C is an exploded perspective view showing a beam structure according to the present invention in which channels of the third example have been employed together with a connection structure of the beam structure with respect to a pillar structure according to the present invention. FIG. 13A is a perspective view showing a connection piece of a T-shaped section which is employed with a connection of a pillar and beam structure according to the present invention. FIG. 13B is a perspective view showing a connection piece of an L-shaped section which is employed with a connection of a pillar and beam structure according to the present invention.

The connection structure of the tubular structure will be described with reference to FIGS. 12A through 13B together with FIG. 10.

The connection structure between the vertically extended pillar structures according to the present invention uses a T-shaped connection piece 40 or an L-shaped connection piece 42 on which connection holes 44 are formed as shown in FIGS. 13A and 13B. Besides, the above-described wide flange 30, bolts 70, nuts 72 and a thickness adjustment plate 60 on which connection holes 62 are formed are used for the connection structure.

First, the wide flange 30 is disposed between the lower pillar structure and the upper pillar structure which are vertically installed with respect to each other. Two connection pieces 40 each having a T-shaped section are fixedly connected on the wide flange 30 which is exposed between the pillar structures with an appropriate interval according to the space interval of the beam structure.

Then, the beam structure obtained by assembling a pair of channels 20, 20*a* or 20*b* which are abutted with each other, are horizontally abutted on a corresponding position of the wide flange 30 having a predetermined interval vertically.

As shown in FIG. 12A, two channels 20 of the first example according to the present invention are abutted and engaged with a long bolt 71 and a nut 73, to thereby form a beam structure. The assembled beam structure is fitted into connection holes 44 on the connection pieces 40 each having a T-shaped section which are opposed and fixed to each other, to then be engaged with bolts 70 and nuts 72. Here, part of the flanges 25 on the channels 20 each having a C-shaped section with inwardly bent flanges is removed in order to prevent a contact to the connection pieces 40.

The channels 20*a* of the second example which is used in the second embodiment of the present invention as shown in FIG. 12B, and the channels 20*b* of the third example which is used in the third embodiment of the present invention as shown in FIG. 12C, are assembled into a beam structure in the same manner as that of the first embodiment of the present invention. Then, the assembled beam structure is fitted into connection holes 44 on the connection pieces 40 each having a T-shaped section which are opposed and fixed to each other, to thereby complete a connection structure of the beam structure with the channels 20*a* and 20*b* of the second and third examples which are used in the second and third embodiments of the present invention.

Figure 14:
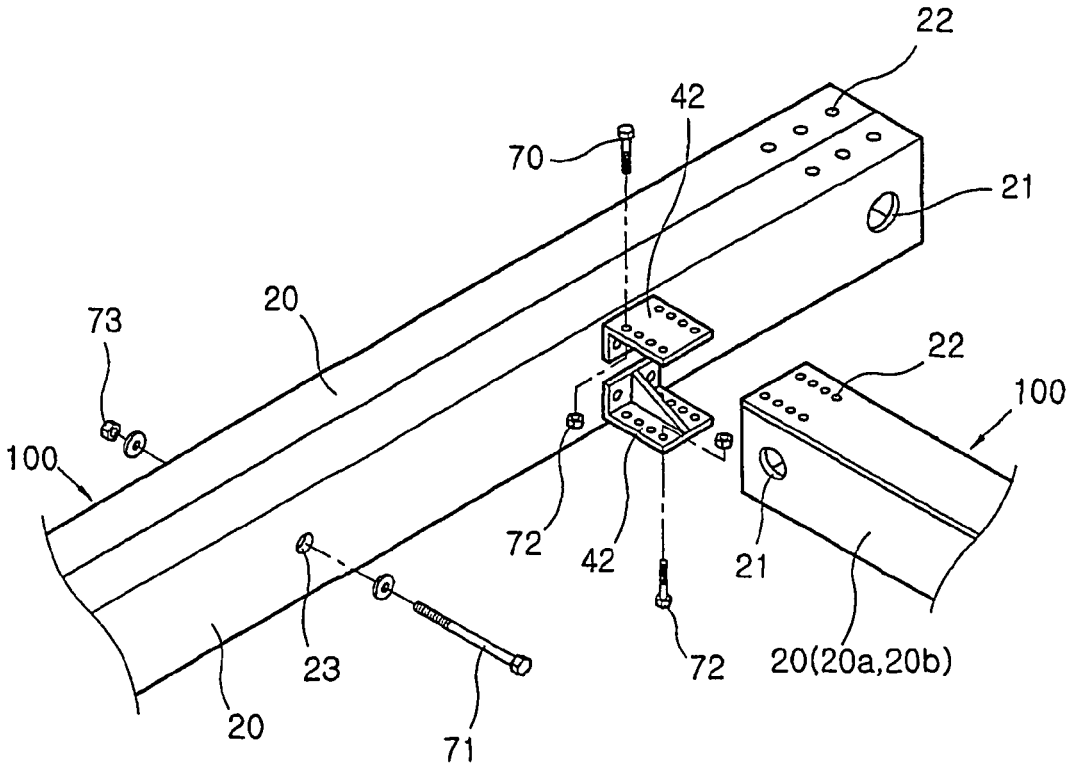
FIG. 14 is a perspective view showing a connection structure for a beam to a beam according to the present invention.

FIG. 14 is a perspective view showing a connection structure of a beam to a beam according to the present invention.

In the case of a beam structure according to the present invention, various types of beam structures can be prepared by using the channels 20, 20*a* and 20*b* of the first through third examples according to the first through third embodiments of the present invention.

In the case that a beam structure has been prepared, two upper and lower connection pieces 42 each having an L-shaped section are fixed on predetermined positions of the beam structure, and then the prepared beam structure is fitted and engaged with the previously assembled beam structure, to thereby accomplish a connection between a beam structure and a beam structure.

Figure 15:
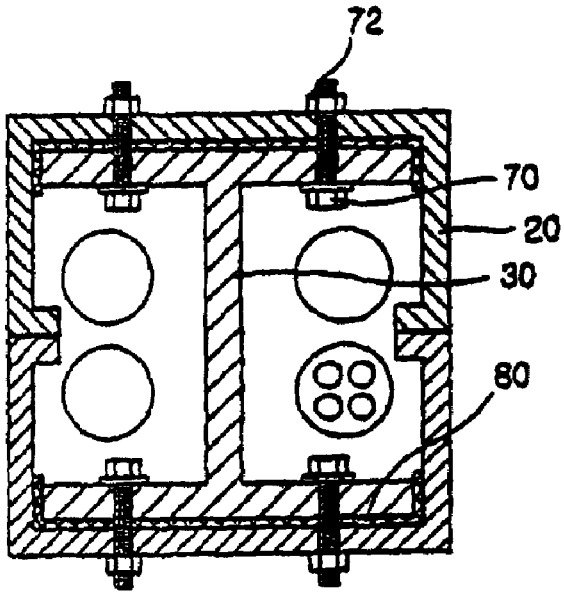
FIG. 15 is a sectional view showing an example of a layout where pipes for water supply and drainage, telecommunication and power cables, etc., pass through the inside of the pillar structure or beam structure according to the present invention.
Figure 16:
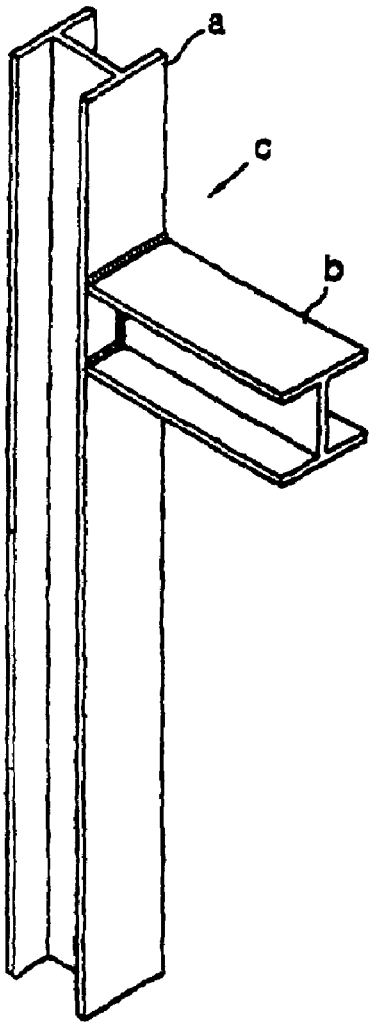
FIG. 16 (PRIOR ART)
FIG. 16 is a perspective view showing a conventional pillar structure and a connection state where a beam is connected to the pillar structure.

FIG. 15 is a sectional view showing an example of a layout where pipes for water supply and drainage, telecommunication and power cables, etc., pass through the inside of the pillar structure or beam structure according to the present invention. As shown in FIG. 15, in the case of the structure according to the present invention, ducts for water supply and drainage, telecommunication and power cables, etc., can be installed through the structure after completing a predetermined building.

As described above, the present invention provides a tubular structure such as a pillar structure or a beam structure by using channels and connection members each having a predetermined shape, without requiring welding. Also, the structures can be assembled on site without pre-assembling transporting the structures to the working site. Further, assembly is simplified to reduce the installation cost and enhance an excellent construction efficiency to shorten a construction period. This permits the use of a small number of persons to install and construct the structures. Also, moisture formation can be prevented at a connection portion. An assembled product becomes light-weight to thereby provide an easy transportation. A path formed in the structure can contain pipes for water supply and drainage, telecommunication and power cables, etc.

What is claimed is:

1. A hollow elongated tubular structure comprising:

a first elongated C-shaped channel having a central, main section and two integral end sections, and integral, inwardly extending flanges only along the length of said main section, a second elongated C-shaped channel having a central, main portion and two integral end portions with flanges only along the length of said main portion, said second channel being of the same configuration as said first elongated C-shaped channel, and a holding member located in each channel end section and fixedly connecting said first and second channels together so that the flanges located in the main section of said first channel contact the flanges located in the main section of said second C-shaped channel, wherein the flanges of said first and second C-shaped channels have an inward bend and the surfaces of the flanges coming in contact with each other are planar and form an airtight seal along the length thereof.

2. A tubular structure according to claim 1, wherein said first and said second channels are made of rigid material so that the tubular structure is substantially non-deformable and further comprising detent means to maintain the spatial distance between opposing inside faces of the two C-shaped channels a predetermined distance as said holding means is placed to couple and tighten said two C-shaped channels together.

3. A tubular structure according to claim 1, wherein said channels are made of steel.

4. A tubular structure according to claim 1, wherein said means for holding said first and said second C-shaped channels together comprises bolting means having a bolt with a head, threaded stem and a nut, and whereby said detent means maintains the spatial distance between the opposing inside faces of the two C-shaped channels as said bolt is placed and said nut is rotated.

5. A building assembly comprising hollow tubular structures according to claim 2, wherein a plurality of said structures are adopted for use as beams and as pillars selectively, and further comprising means for anchoring bottom ends of selected ones of said pillars on a support foundation for a building and means for coupling a second pillar on top of said first pillar, end to end, and means for coupling said beams to said pillars, thereby resulting in a framework for a modular building.

6. A building assembly according to claim 5, wherein said anchoring means comprises a flange of a predetermined design with a plurality of holes at predetermined positions, an end of the hollow tubular structures used as pillars provided with a plurality of holes at predetermined positions for alignment with the holes in the flange, and a plurality of nuts, washers and bolts for bolting the one end of the pillar to the flange and the other end of the flange to the foundation.

7. An assembly according to claim 6, including said anchoring means for the pillar including an L-shaped flange, with a first leg portion provided with holes for receiving threaded rod of bolts, the heads of which are embedded in a solid foundation for the building, and a second leg portion having holes to align with holes provided through the sides of the bottom end of the pillar, nuts, bolt and washer means for bolting the end portion of the pillar to the second leg portion of the flange and for bolting the first leg portion of the flange to the foundation, for anchoring the pillar to the building foundation.

8. A building assembly comprising a plurality of hollow tubular structures, each structure comprising a first elongated C-shaped channel with flanges along the length thereof, a second elongated C-shaped channel with flanges along the length thereof of the same design as said first elongated C-shaped channel, wherein said first and said second channels are made of rigid material so that the tubular structure is substantially non-deformable, means for holding the two channels together so that the flanges of said first C-shaped channel contact the flanges of said second C-shaped channel, and detent means to maintain the spatial distance between opposing inside faces of the two C-shaped channels a predetermined distance as said holding means is placed to couple and tighten said two C-shaped channels together, wherein the flanges of said first and second C-shaped channels are respectively inwardly bent and the surfaces of the flanges coming in contact with each other are planar and form an airtight seal along the length thereof and thereby forming a hollow elongated tubular structure, and wherein a plurality of said structures are adopted for use as beams and as pillars selectively;

a means for anchoring bottom ends of selected ones of said pillars on a support foundation for a building;

a first means for coupling a second pillar on top of said first pillar, end to end, wherein the first coupling means includes an H-shaped type flange of a size such that it fits inside the hollow space of the pillars and being positioned so that one end thereof being fitted inside the top end portion of the first pillar, the other end thereof being fitted inside the bottom end of a second pillar, said H-shaped flange and the end portions of said first and second pillars are provided with a plurality of holes at predetermined positions, nuts, bolts and washers for bolting the first and the second pillars to the H-shaped flange through the holes; and a second means for coupling said beams to said pillars, for building a framework of a modular building.

9. An Assembly according to claim 8, wherein said H-shaped flange is positioned to provide continuity of empty space between the two pillars, whereby utility lines such as water pipe, communications or power supply cable lines can be run through the hollow spaces provided by the first and the second hollow tubular pillars, said H-shaped flange and said top end portion of first pillar and the bottom end portion of the second pillars are provided with holes at predetermined positions.

10. An Assembly according to claim 8, wherein said second coupling means includes T-shaped flanges designed to fit inside the hollow space of the beam made of the pillar structure, wherein said T-shaped flanges and an end portion of the beam are provided with a plurality of holes at predetermined positions, nut, bolt and washers or fastening the T-shaped flange to the H-shaped flange and to the beam through the plurality of holes provided therein for mounting the beam transverse to the pillar.

11. An assembly according to claim 10, wherein the flanges of the beam toward the end thereof are eliminated to accommodate the T-shaped flange being inserted into the hollow beam.

12. An assembly according to claim 8, comprising a pair of T flanges having a base portion and a leg portion connected perpendicularly to said base portion, each said T flange having a plurality of holes therein at predetermined positions, said pair of T flanges dimensioned and positioned so that their respective base portions are in parallel and the leg portions of said flanges meeting the inner surface at the end section of the C-shaped channel, and nuts, washers and bolts which bolt together the beam end to the H-shaped member that couples two pillars.

13. An assembly according to claim 12, wherein said beams and said pillars are provided with plugable access holes adjacent the holes in the ends of the tubular means used as pillars and as beams for facilitating the access into the inner hollow space of the pillars and beams for facilitating the bolting operations for mounting the bolts and nuts and washers, to couple and tighten pillars to the building foundation, pillars to pillars, and beams to pillars, for facilitating the assembly of a building.

14. An assembly according to claim 13, wherein an insulating means is inserted between the T flanges and the end portions of the two pillars such that the hollow space inside of the two pillars is insulated from the exterior.

15. In a tubular structure:

a first elongated C-shaped channel having a central, main section and two integral end sections, said first C-shaped channel comprising a first centrally disposed web portion, a first upper flange, and a first lower flange, each of said first upper and lower flanges having outer edges disposed away from said web portion, and a first lip located only in said main channel section having inner and outer edges and inner and outer surfaces, said outer edge of said first lip connected substantially at right angles to said outer edge of said first upper flange along longitudinal lengths thereof, and a second lip located only in said main channel section having inner and outer edges and inner and outer surfaces, said outer edge of said second lip connected substantially at right angles to said outer edge of said first lower flange along longitudinal lengths thereof;

a second elongated C-shaped channel having a central, main section and two integral end sections, said second C-shaped channel comprising a second centrally disposed web portion, a second upper flange, and a second lower flange, each of said second upper and lower flanges having outer edges disposed away from said web portion, and a third lip located only in said main channel section having inner and outer edges and inner and outer surfaces, said outer edge of said third lip connected substantially at right angles to said outer edge of said second upper flange along longitudinal lengths thereof, and a fourth lip located only in said main channel section having inner and outer edges and inner and outer surfaces, said outer edge of said fourth lip connected substantially at right angles to said outer edge of said second lower flange along longitudinal lengths thereof;

wherein inner edges and outer surfaces of said first and second lips face towards each other, and inner edges and outer surfaces of said third and fourth lips face towards each other;

a holding member located in each channel end section and fixedly connecting said first and second channels together so that the flanges located in the main section of said first channel contact the flanges located in the main section of said second channel, a holding member located in each channel end section and fixedly connecting said first and second channels together so that the surfaces of respective flanges located in the main section of said first C-shaped channel are held to touch corresponding surfaces of flanges located in the main section of said second C-shaped channel, planar surfaces of the first and second flanges being in contact with corresponding planar surfaces of the third and fourth flanges, whereby an airtight seal is formed there between along a length thereof;

and further comprising a detent means disposed between respective inside faces of said central web portions of said first and second C-shaped channels that space said inside faces of the two C-shaped channels from each other by a predetermined distance;

whereby a hollow elongated tubular structure is formed.

* * * * *